US006554909B1

(12) United States Patent
Haerle et al.

(10) Patent No.: US 6,554,909 B1
(45) Date of Patent: Apr. 29, 2003

(54) PROCESS FOR CLEANING COMPONENTS USING CLEANING MEDIA

(75) Inventors: Andrew G. Haerle, Sutton, MA (US); Edward A. Perry, Clinton, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 0 days.

(21) Appl. No.: 10/010,470

(22) Filed: Nov. 8, 2001

(51) Int. Cl.[7] ..... B08B 7/00

(52) U.S. Cl. ..... 134/6; 134/2; 134/7; 134/26; 134/34; 134/36; 134/42; 134/902; 451/38; 451/39; 451/40; 451/75; 451/102

(58) Field of Search ..... 134/6, 7, 2, 26, 134/34, 36, 42, 902; 451/38, 39, 40, 75, 102

(56) References Cited

U.S. PATENT DOCUMENTS 4,707,951 A 11/1987 Gibot et al. ..... 51/410
5,551,165 A 9/1996 Turner et al. ..... 34/404
6,004,400 A 12/1999 Bishop et al. ..... 134/2
6,022,400 A * 2/2000 Izumi et al. ..... 106/3
6,190,237 B1 * 2/2001 Huynh et al. ..... 451/41
6,296,716 B1 10/2001 Haerle et al. ..... 134/7
6,451,696 B1 * 9/2002 Hara et al. ..... 438/691

FOREIGN PATENT DOCUMENTS

WO 02/09161 A3 1/2002 ..... B24C/1/00

* cited by examiner

*Primary Examiner*—Sharidan Carrillo
(74) *Attorney, Agent, or Firm*—Toler, Larson & Abel, L.L.P.; Jeffrey S. Abel

(57) ABSTRACT

A method for cleaning a semiconductor processing component is provided. The process calls for directing a stream of cleaning media at a surface of the component, the cleaning media including zirconia. After cleaning with the cleaning media, frozen $CO_2$ (dry ice) pellets may be directed at the surface to further clean the component.

34 Claims, 7 Drawing Sheets

PROCESS FOR CLEANING COMPONENTS USING CLEANING MEDIA

CROSS-REFERENCE TO RELATED APPLICATION(S)

BACKGROUND

1. Field of the Invention

The present invention relates generally to processes for cleaning components using cleaning media, and more particularly to processes for cleaning semiconductor process components used in the manufacture of semiconductor devices, using cleaning media.

2. Description of the Related Art

In the art of semiconductor processing, various semiconductor processing components are used to handle semiconductor wafers during batch processing as well as during single wafer processing. Such components are also known in the art as 'handling implements' or 'work pieces,' particular examples including quartz and silicon carbide wafer boats, paddles, carriers, and the like. As is understood in the art, semiconductor fabrication is a time-consuming and highly precise process, during which cleanliness of the working environment is of utmost importance. In this regard, semiconductor "fabs" include various classes of clean-rooms having purified air flows to reduce incidence of airborne particle contaminants.

As a part of the semiconductor fabrication process, wafers are exposed to high temperature environments, during which exposure various types of materials are deposited for formation of integrated circuits on the semiconductor die of the wafers. During such high temperature processes, layers such as silicon oxide (including TEOS, and thermally-grown oxide), polysilicon, silicon nitride, photoresist, and various metallic layers such as aluminum and copper are deposited. Invariably, such layers are also deposited on the wafer processing components utilized to handle the wafers.

With increased integration and density of semiconductor devices, and attendant shrinking of photolithographic patterns on the semiconductor die, it has become increasingly important to safeguard the cleanliness of the processing environment. In this regard, the materials deposited on the semiconductor processing components as noted above have been identified as a source of contamination during processing. Accordingly, various techniques have been employed in the art to clean semiconductor processing components after a predetermined number of cycles of use.

Cleaning of semiconductor processing components may be generally categorized into two major types, wet cleaning, which typically removes layers by dissolution (e.g., submersion into an acid solution to remove deposited layers), and dry cleaning, which primarily relies upon mechanical removal of deposited layers. While wet cleaning has been employed in the art and has been recognized as an effective means to remove unwanted materials on semiconductor processing components, wet processes suffer from numerous disadvantages. Particularly, the cycle time to effect material removal is lengthy, the cost of employing wet processes is relatively high, and technically sophisticated equipment is required to address out-gassing issues. In addition, wet cleaning methods typically trigger environmental health and safety concerns in view of the aggressive chemicals that are utilized to effect removal. Still further, in certain circumstances, it is difficult to control dissolution of the underlying substrate, such as dissolution of silicon (Si) in the case of silicon carbide (SiC) semiconductor processing components.

Dry cleaning processes address many of the disadvantages associated with wet processes. The advantages of dry processes over wet processes include reduced cycle time, elimination of out-gassing, low cost, and ease of implementation. Typically, dry cleaning processes involve flowing an alumina ($Al_2O_3$) or silicon carbide (SiC) abrasive material, akin to sand blasting. However, state of the art processes typically suffer from inefficient layer removal, or overly-aggressive layer removal, leading to damage of the underlying substrate, i.e., the semiconductor processing component. In severe cases, such damage can lead to chipping or breaking of the component. Certain processing components utilize a multi-phase structure, as in the case of silicon carbide semiconductor processing components coated with a silicon carbide layer formed by chemical vapor deposition (CVD). Component damage is particularly problematic with such multi-phase components.

Accordingly, a need exists in the art for improved cleaning processes, particularly, improved cleaning processes particularly suited for cleaning of semiconductor processing components having any one of or a combination of layers commonly deposited during state of the art semiconductor processing techniques.

SUMMARY

In one aspect of present invention, a method for cleaning a semiconductor processing component is provided. The process calls for directing a stream of cleaning media at a surface of the component, the cleaning media including zirconia.

In another aspect of the present invention, a method for cleaning a component is provided. The process calls for directing a stream of cleaning media at a surface of the component, the cleaning media including zirconia, and directing a flow of frozen $CO_2$ pellets against the surface of the component.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
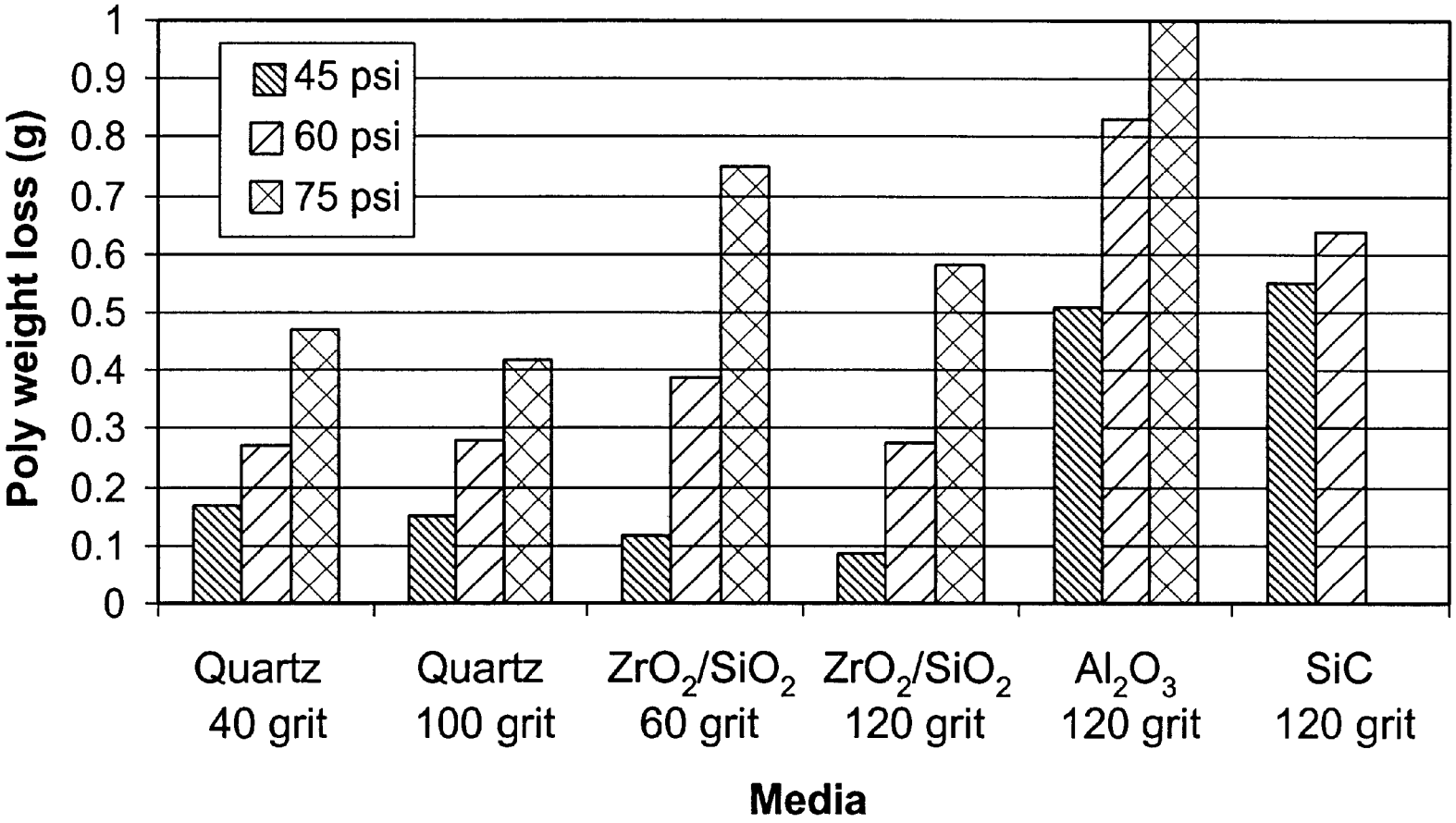
FIG. 1 is a bar graph representing the effectiveness of polysilicon removal according to embodiments of the present invention and comparative examples.

Turning to the details of embodiments of the present invention, a method is provided in which a component, such as a semiconductor processing component, is cleaned by directing a stream of cleaning media at a surface of the component, the cleaning media including at least zirconia ($ZrO_2$). The cleaning media are generally directed at the component via a gaseous pressurized stream, akin to sand blasting. However, it is understood that other fluid streams may be utilized, including pressurized liquid. Typically, the stream of cleaning media is directed at the component via a pressurized gaseous flow of compressed ambient air using equipment known in the art.

According to an embodiment of the present invention, the cleaning media are directed at the surface of the semiconductor processing component at a pressure effective to remove unwanted deposited materials on the component. The pressure may be within a range of about 30 to about 100 psi, typically within a range of about 45 to about 75 psi.

As stated above, the cleaning media of a particular embodiment of the present invention include at least zirconia. Preferably, the cleaning media include zirconia and a second, glassy phase formed by amorphous silica ($SiO_2$). The zirconia is generally stabilized through use of at least one stabilizing agent, such as ceria, hafnia, and/or yttria. These stabilizing agents are effective to improve the toughness of the zirconia material, particularly the fracture toughness of the material. According to an embodiment of the present invention, the fracture toughness $K_c$ of the cleaning media is greater than about 4 $MPam^{0.5}$, generally greater than about 6 $MPam^{0.5}$, and preferably greater than about 8 $MPam^{0.5}$. As discussed in more detail below, the cleaning media are generally effective to remove unwanted material or layers on the component to be cleaned. In this regard, the cleaning media generally have a hardness greater than the hardness of the material targeted for removal. Table I below provides a list of commercially available zirconia/silica ceramic media that may be employed according to embodiments of the present invention. The media are known as ZIRBLAST™ (zirconia/silica) ceramic beads available from Saint-Gobain Corporation, and utilize a hafnia stabilizing component. Typical crystallographic data show 68% zirconia and 32% silica. The theoretical density is 3.85 $g/cm^3$, and the relative density is 3.76 $g/CM^3$. The spheroidal shape of the beads has been quantified by measuring 'loose pack density' (LPD) and normalizing LPD by dividing measured average LPD values by the relative density of the material. The normalized LPD according to embodiments of the present invention is greater than 0.55, more particularly greater than about 0.58. Actual normalized LPDs from an average of powder samples were 0.59, 0.60, and 0.61. All values were calculated based on a relative density of 3.76 $g/cm^3$. By comparison, other commercially available cleaning media were measured to have lower normalized LPDs. For example, the normalized LPD was 0.46 for SiC samples, 0.47 for $Al_2O_3$, and 0.55 for quartz.

TABLE 1

| | NOMINAL DIAMETER | |
|---|---|---|
| GRIT | MESH | mm |
| 20 | 20/30 | 0.600–0.850 |
| 30 | 30/40 | 0.425–0.600 |

TABLE 1-continued

| | NOMINAL DIAMETER | |
|---|---|---|
| GRIT | MESH | mm |
| 40 | 40/60 | 0.250–0.425 |
| 60 | 60/120 | 0.125–0.250 |
| 120 | 120/200 | 0.070–0.125 |
| 125 | −0120 | 0–0.125 |
| 205 | | 0.063 |

Typically, the ceramic beads of the cleaning media have a nominal diameter within a range of about 1 mm to about 0.05 mm, more typically within a range of about 0.25 mm to about 0.1 mm. Particular examples of the present invention utilize 60 grit or 120 grit media, having the associated nominal diameter ranges noted above in Table 1.

Embodiments of the present invention include a wide variety of semiconductor processing components formed of a wide variety of materials. Such components typically include (at least along the surface portion thereof that is subjected to cleaning) ceramic materials such as those ceramics commonly used in semiconductor fabrication. However, the process may be applied to non-ceramic materials as well. By way of example, common materials include, but are not limited to, silicon (Si), silicon carbide (SiC), silicon nitride ($Si_3N_4$), yttria ($Y_2O_3$), zirconia ($ZrO_2$), aluminum nitride (AlN), aluminum oxide ($Al_2O_3$), carbon (C) in graphite and diamond forms, polycrystalline and fused quartz, and sapphire.

The surface of the component to be cleaned (on which unwanted material is deposited) may be defined as a vapor-deposited surface layer, formed, by example, using CVD techniques. Such surface layers include, but are not limited to, CVD Si, i quartz ($SiO_2$), $Si_3N_4$ and carbon (diamond structure) surfaces. For clarity, it is to be understood that the surface layers noted above are not targeted for removal according to embodiments of the present invention. Rather, the unwanted material deposited thereon, such as materials deposited during semiconductor processing as described in more detail below, are targeted for removal.

In one embodiment of the present invention, SiC is used as the material for the semiconductor processing component. The component may be a recrystallized SiC component, optionally machined to reach its final dimensions, and may have reduced surface porosity by loading of the surface pores with Si. Many components carrying Si for porosity reduction are further coated with a CVD SiC layer. More specifically, these components typically are formed of a porous α-SiC body having Si occupying surface pores, and further coated with a layer of CVD β-SiC. The β-SiC functions to seal the surface and inhibit loss of Si near the surface of the component. In addition, the CVD SiC layer functions to prevent migration of impurities contained in the body of the component to the outer surface of the component.

It should be understood that the β-SiC layer deposited on the component is not intended to be removed according to embodiments of the present invention. For clarity, removal of coatings from used semiconductor processing components as described herein according to embodiments of the present invention generally refers to coatings that have been deposited on the component during its use in semiconductor processing. Thus, a "virgin" coated processing component refers to a newly manufactured component (optionally having a desired coating formed thereon), while a used, coated processing component refers to a component having an undesired coating deposited during semiconductor processing. In any event, the unwanted deposited material generally has a different composition than that of the underlying substrate (i.e., the processing component). For example, the underlying substrate may be a SiC layer (deposited on an SiC component as described above), while the unwanted deposited layer is made up of polysilicon, silicon nitride, or silicon oxide.

The particular form of the semiconductor processing component treated according to embodiments of the present invention may vary, and includes single wafer processing and batch processing components. Single wafer processing components include, for example, bell jars, electrostatic chucks, focus rings, shadow rings, chambers, susceptors, lift pins, domes, end effectors, liners, supports, injector ports, manometer ports, wafer insert passages, screen plates, heaters, and vacuum chucks. Examples of semiconductor processing components used in batch processing include, for example, paddles (including wheeled and cantilevered), process tubes, wafer boats, liners, pedestals, long boats, cantilever rods, wafer carriers, vertical process chambers, and dummy wafers.

Following cleaning by use of cleaning media as described above, one embodiment of the present invention incorporates a chemical stripping step, during which the surface of the component is exposed to a chemical stripping agent in the form of a fluid (gas or liquid). This step is effective to remove elemental contaminants remaining on the surface of the component, such as metallic contaminants.

The chemical stripping step can employ a wide variety of chemical stripping agents. In particular, it may be a solvent having at least 1 v/o of an acid selected from the group consisting of HF, acids having a pKa of less than about one, and mixtures thereof In one embodiment, the chemical stripping agent is selected from the class of chlorinated acids. In particular, a chlorinated acid such as HCl can be used. Although HCl is desirable due to its high level of dissociation, other acid chlorides, including but not limited to chloroacetic acid, chloropropanic acid and chlorobenzoic acid may also be used. The chemical stripping step may be advantageously carried out at elevated temperatures, i.e., about 85° C. and above, as such temperatures have been found to result in improved surface purity. Exemplary gas-phase chemical stripping agents include halogen gasses and gasses containing halogenated compounds, such as gas phase chlorine, fluorine, bromine, iodine, etc., or gas-phase chlorinated compounds such as SiCl4. Gas-phase halogenated organic compounds may be used as well. These include, but are not limited to 1,1,1-trichloroethane (TCA) and 1,2-trans-dichloroethylene (DCE).

According to a particular embodiment of the present invention, following the step of directing the stream of cleaning media at a surface of the component, the component is further cleaned by directing a flow of frozen $CO_2$ (dry ice) pellets against the surface of the component. In the case of incorporating a chemical stripping step as discussed above, $CO_2$ cleaning is generally carried out after chemical stripping. Details of the $CO_2$ cleaning are provided in U.S. Pat. No. 6,004,400, hereby incorporated by reference. The additional $CO_2$ cleaning step has been found to be particularly advantageous in providing a further level of purity and cleanliness with respect to the semiconductor processing component. In this regard, the additional $CO_2$ cleaning step has been found to remove substantial amounts of sub-micron particles remaining on the surface of the component following the cleaning step with the cleaning media described above. For example, embodiments of the present invention have a metallic contaminant concentration of at most 600 ppm, typically lower than about 400 ppm, as measured by SIMS at a depth of about 10 nm. Certain embodiments advantageously have a metallic contaminant concentration lower than about 225 ppm.

In one aspect of the present invention, upon completing the $CO_2$ cleaning step, the cleaned component is installed into a furnace used for processing semiconductor wafers. In another aspect, the cleaned component is placed into a bag used for the shipping and storage of cleaned semiconductor processing components. In the former process, the component is transferred directly from $CO_2$ cleaning into the furnace without any further cleaning steps. In the latter process, the component is packaged, i.e., placed into a sealable container such as a bag and sealed, directly following $CO_2$ cleaning without any further cleaning steps. In this latter case, upon removing the component from its packaging, the component may be installed directly into a furnace used for processing semiconductor wafers without any further cleaning steps. The wafers may be loaded before or after placing the processing component in the furnace. Unlike processes known in the art in which it is necessary to provide additional cleaning steps between removal of the component from its packaging and installation in the furnace, components cleaned using the process according to embodiments of the present invention may be installed into the furnace immediately upon removal from packaging. This is advantageous in that it eliminates additional processing steps which can, among other things, lead to increased levels of contamination, particularly particulate contamination.

In certain circumstances, those using the cleaned components of the present invention have a need to provide additional surface coatings on a component prior to installing it in semiconductor processing equipment. For example, it may be desirable to deposit a polysilicon layer, a silicon oxide layer, a silicon nitride layer, a metallic layer, a photoresist layer or some other layer upon the component prior to using that component in a semiconductor fabrication process. Typically, the semiconductor manufacturer must deposit that layer upon the component once it has been removed from any packaging. To avoid such additional processing steps by the semiconductor manufacturer, an embodiment of the present invention provides for deposition of one or more desired layers provided on its surface following the cleaning process, prior to packaging the component for shipping or storage. Thus, embodiments of the present invention contemplate a process in which, upon completion of the $CO_2$ step, one or more coating layers are provided onto the component surface. Optionally, once the one or more additional coating layers have been provided on the component, a second cleaning employing a $CO_2$ cleaning step, for example, may be applied to the coated component prior to packaging. According to the above-described embodiments of the present invention, the component carrying the additional surface coating(s) has sufficient purity to enable direct use in a semiconductor fabrication process. Accordingly, once the component carrying the additional surface coating(s) is removed from its shipping and storage packaging, it may be deployed in the semiconductor processing environment, such as deployment in a furnace, without any additional cleaning steps and without any additional coating steps.

Purity may be further enhanced by performing any or all of the processing steps in a clean-room environment. Thus, the component may be processed entirely in a clean-room environment following exposure to the cleaning media, or it may be moved to such an environment prior to additional cleaning steps, such as the step of flowing $CO_2$.

The present inventors have found that embodiments of the present invention have been effective at removing unwanted layers of material overlying a target surface of semiconductor processing components. Such layers typically include polysilicon, silicon oxide, silicon nitride, metals, photoresist, and combinations thereof Further, embodiments of the present invention have been found to be particularly effective at removing polysilicon, silicon oxide and silicon nitride, materials commonly deposited during fabrication of semiconductor devices. In addition, embodiments of the present invention are useful for pre-cleaning semiconductor processing components that have not been utilized in semiconductor manufacture, referred to herein as "virgin" components. Such components may have surface contaminants, as well as fingerprints remaining behind from individuals handling the equipment. Typically, following cleaning of virgin processing components, the components are hermetically sealed in a package suitable for storage and/or transport. In this way, semiconductor manufacturers may advantageously remove a virgin component from the sealed packaging and immediately employ the component for manufacture of semiconductor devices, without resorting to on-site pre-cleaning processing steps.

Turning to the drawings, FIG. 1 illustrates the effectiveness of cleaning a deposited polysilicon layer from a substrate, at three different pressure, 45 psi, 60 psi, and 75 psi. Generally, all tested media demonstrated effective removal of deposited polysilicon.

Figure 2:
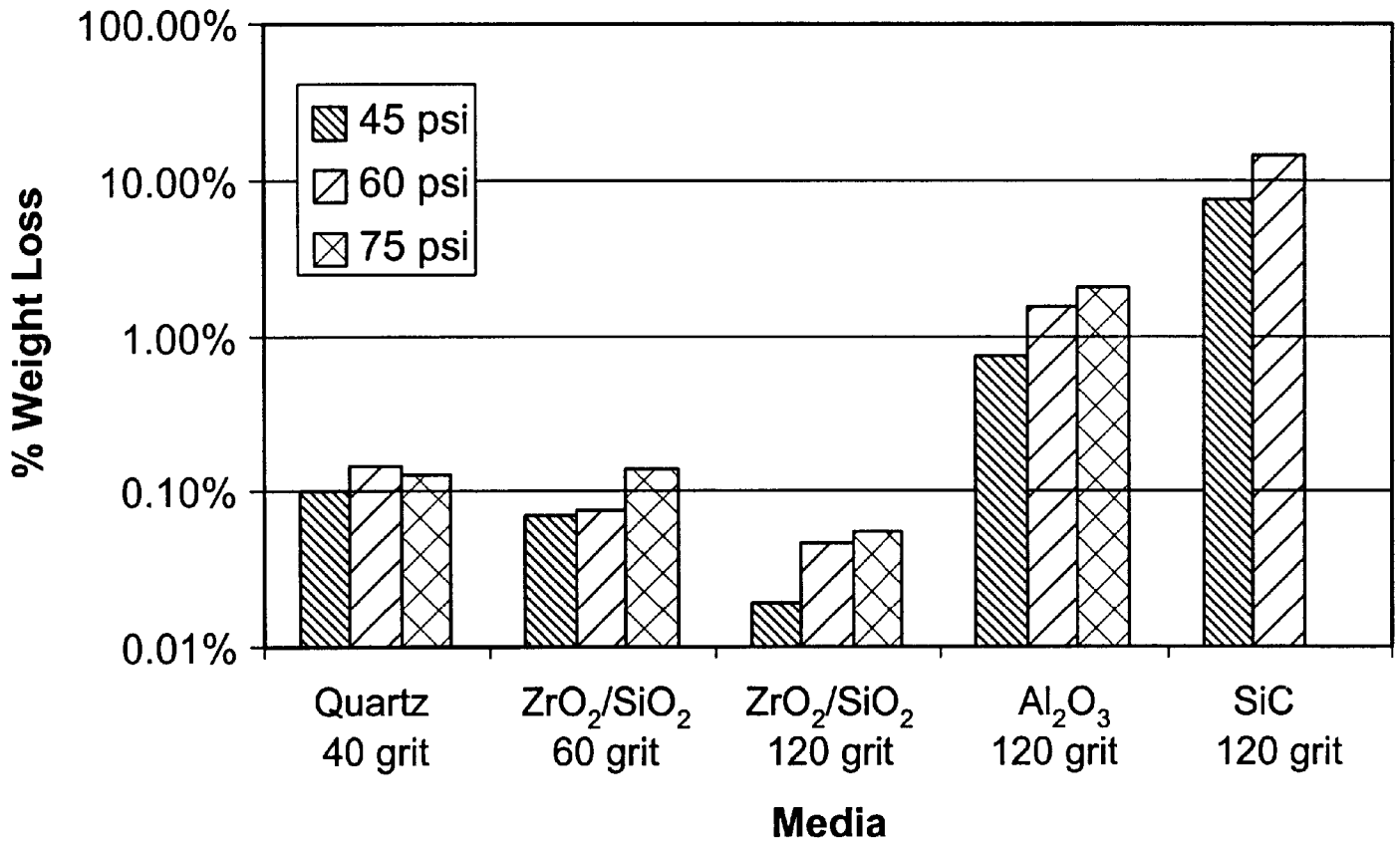
FIG. 2 is a bar graph representing the aggressiveness of substrate removal according to embodiments of the present invention and comparative examples.
Figure 3:
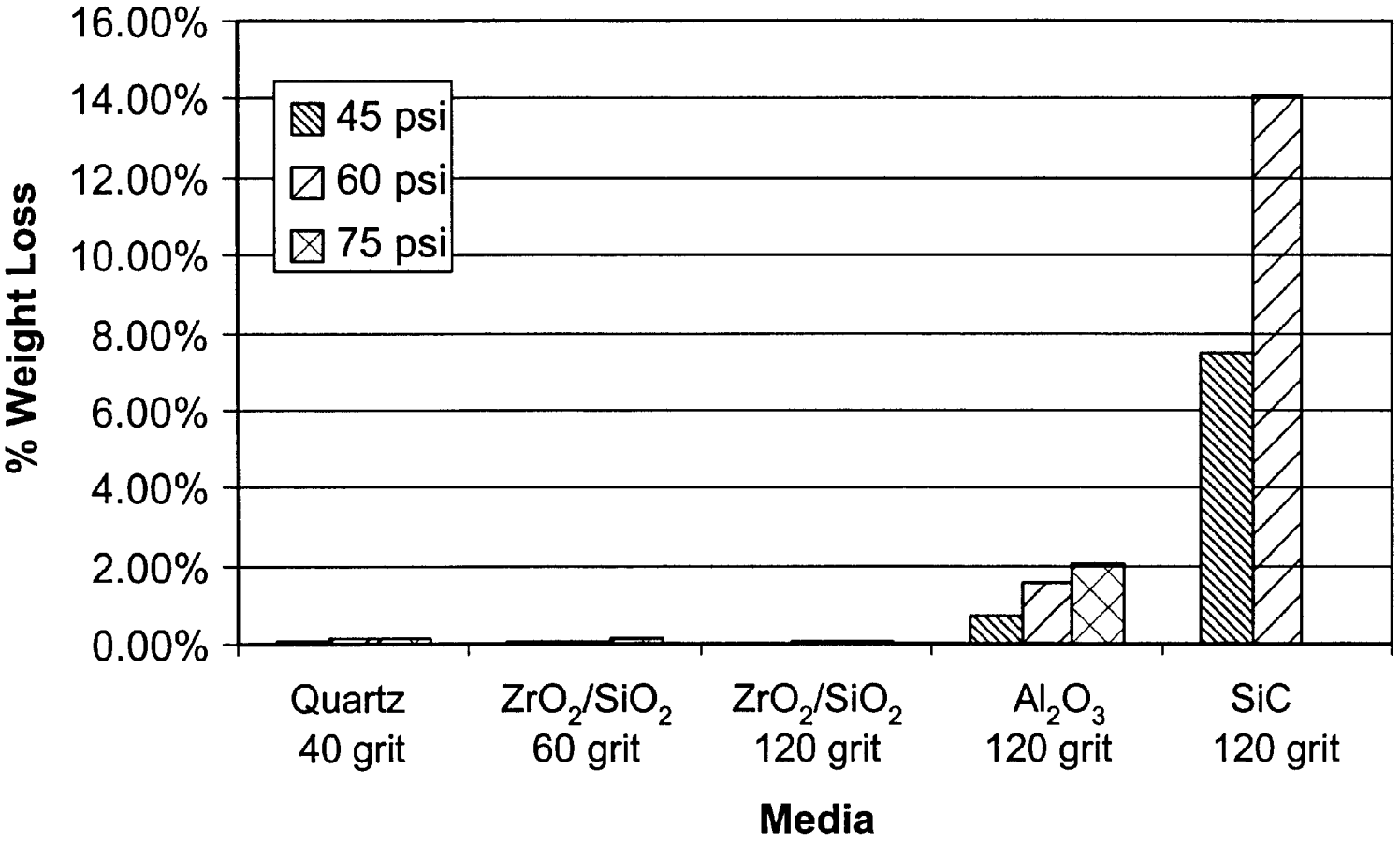
FIG. 3 is a bar graph representing the aggressiveness of substrate removal according to embodiments of the present invention and comparative examples.
Figure 4:
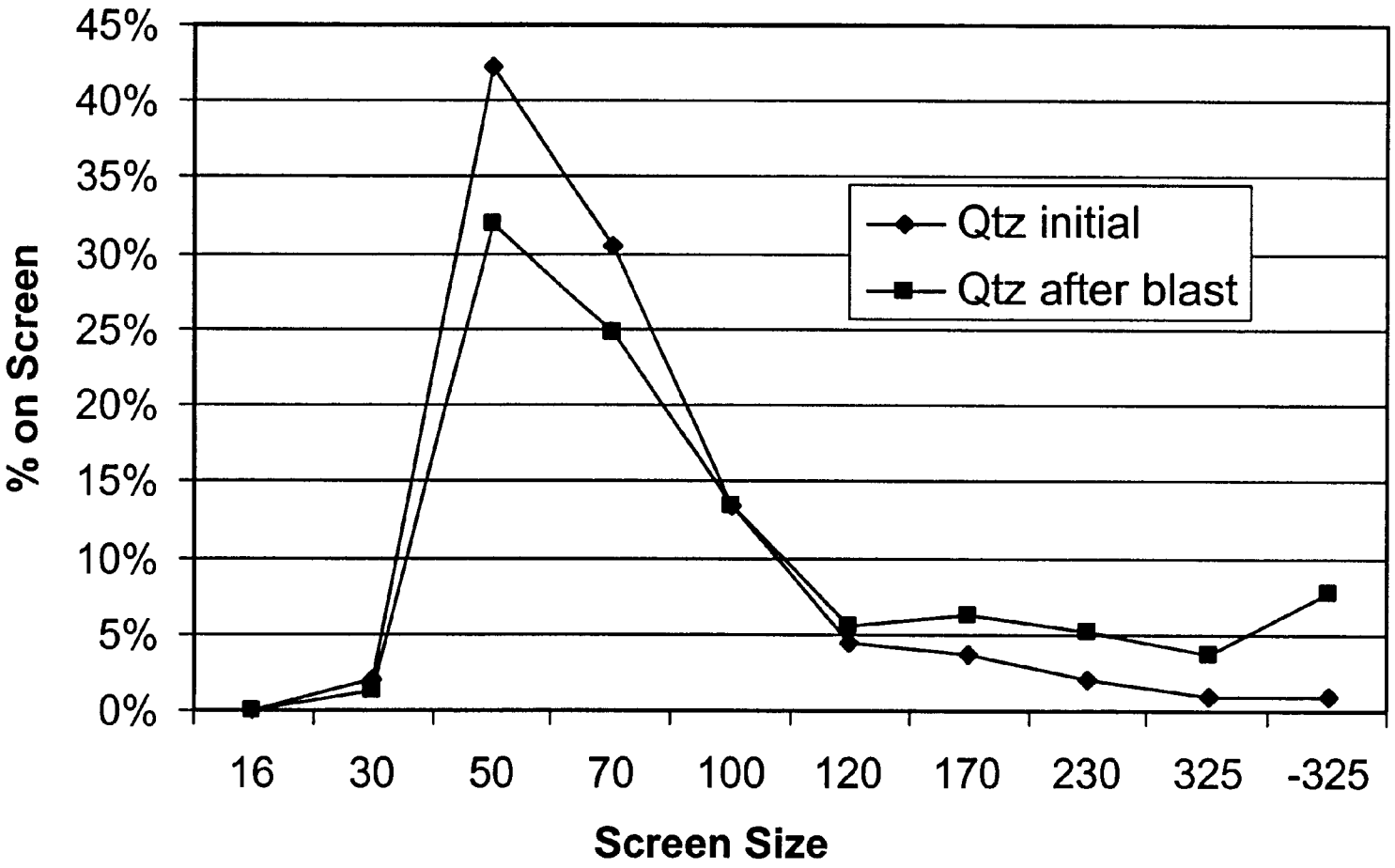
FIG. 4 illustrates the breakdown susceptibility of quartz cleaning media, demonstrated by change in particle size distribution.
Figure 5:
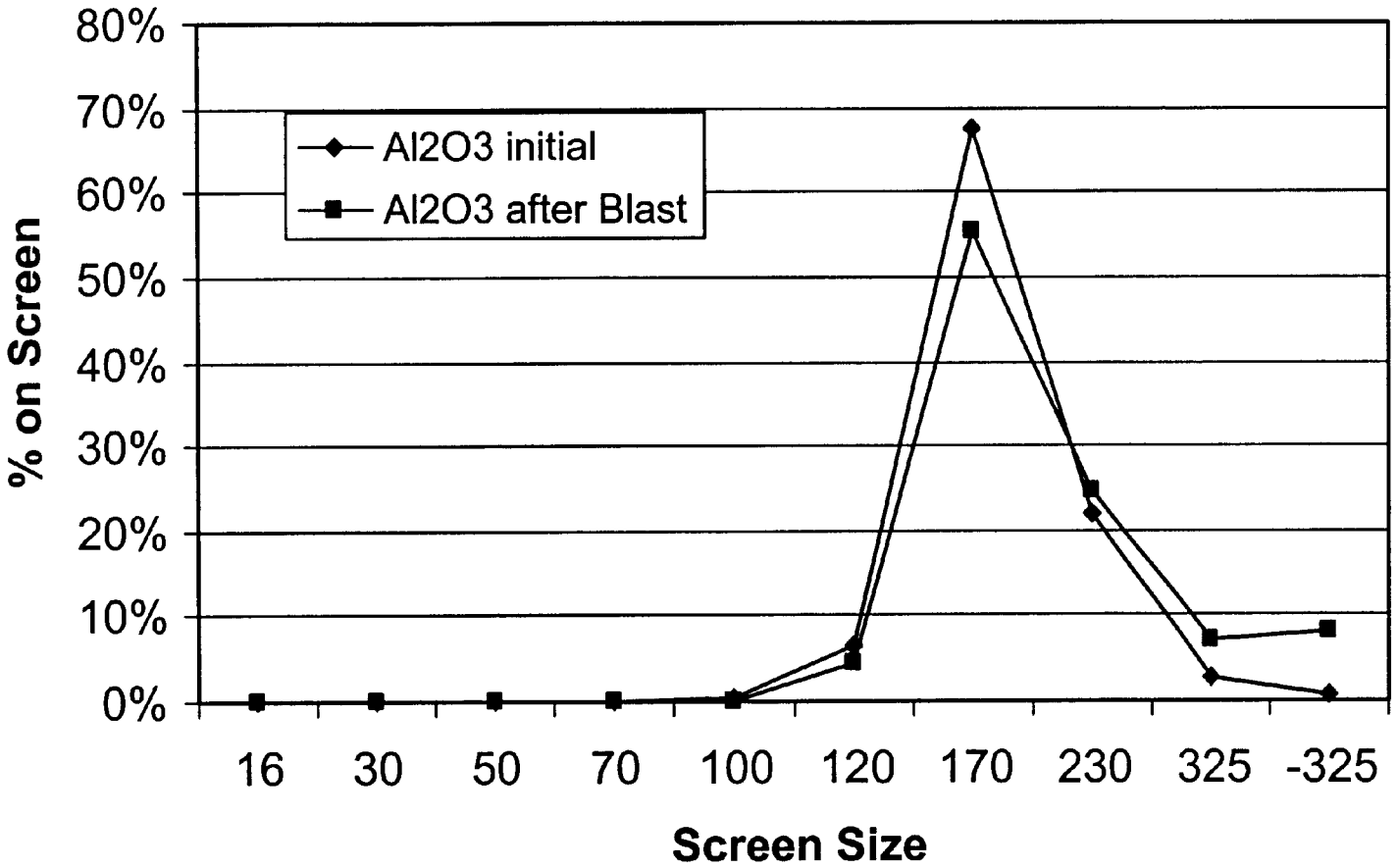
FIG. 5 illustrates the breakdown susceptibility of alumina cleaning media, demonstrated by change in particle size distribution.
Figure 6:
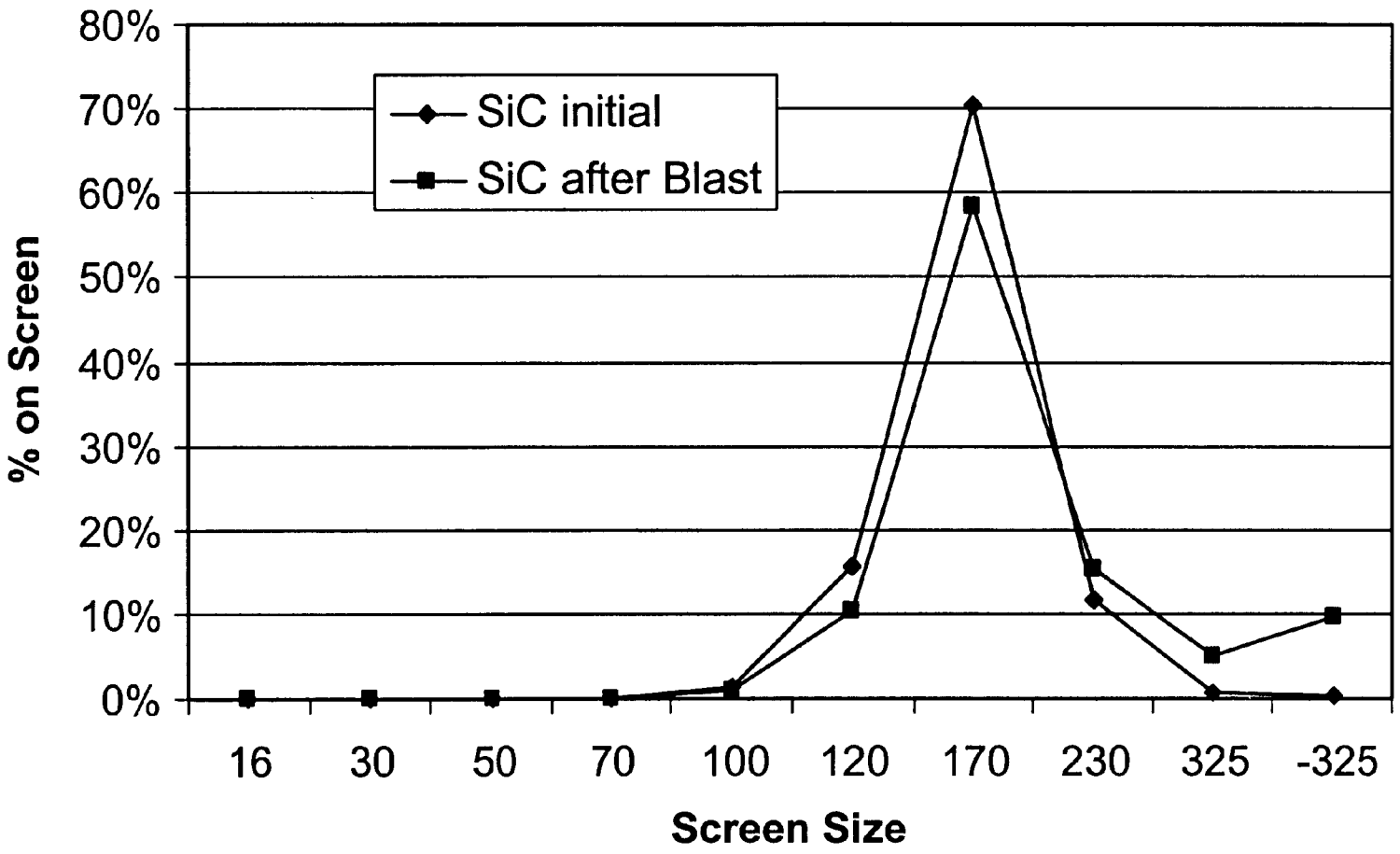
FIG. 6 illustrates the breakdown susceptibility of silicon carbide cleaning media, demonstrated by change in particle size distribution.
Figure 7:
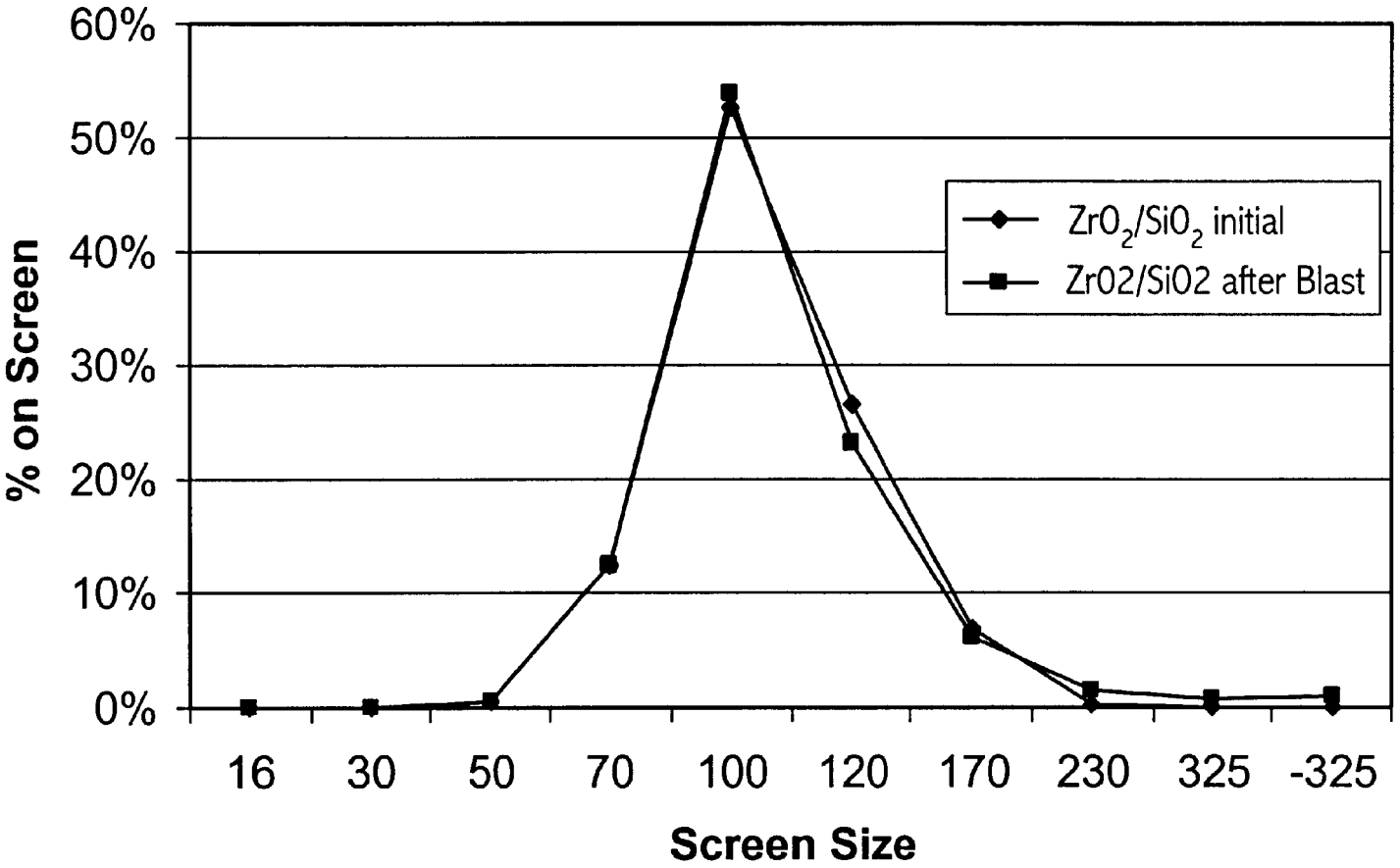
FIG. 7 illustrates the breakdown susceptibility of zirconia/silica cleaning media, demonstrated by change in particle size distribution.

In contrast to FIG. 1, FIGS. 2 and 3 summarize the media aggressiveness to a particular underlying substrate, namely chemical vapor deposited silicon carbide (CVD SiC). FIGS. 2 and 3 represent the same data. FIG. 2 has a logarithmic y-axis, while FIG. has a linear y-axis. In this particular test, it is desirable to minimize the weight loss of the CVD SiC layer, weight loss representing the relative amount of damage to the CVD SiC layer. The test was carried out by placing a blasting nozzle approximately 6 inches from ¾ inch by ¾ inch targets on which a CVD SiC layer was deposited. The nozzle size is 5/16 inches, and each target was blasted for 120 seconds. As shown, the zirconia/silica cleaning media, according to embodiments of the present invention, demonstrated a desirably low percent weight loss of the CVD SiC layer.

The results of polysilicon layer removal and media aggressiveness are described above in FIGS. 1–3. In addition to those characteristics, it is important that the cleaning media employed do not break down during actual use. Breakdown susceptibility can be measured by a shift in the particle size distribution of the cleaning media, typically moving the distribution to a smaller particle size range. Breakdown of the media is undesirable, as the cleaning effectiveness typically reduces as media break into smaller particles. Reduction in cleaning effectiveness generally manifests itself by incomplete removal of layers, increased cycle time, and increased cost. FIGS. 4–7 illustrate the Breakdown susceptibility of various tested media. The media were blasted through a nozzle at a pressure of 60 psi at a distance of 6 inches from a dummy target for a duration of 20 minutes. The collected media were then analyzed and particle size distribution (PSD) was measured. As shown, the zirconia/silica cleaning medium showed superior resistance to breakdown.

While embodiments of the present invention have been described above with particularity, it is understood that those skilled in the art may make modifications to such embodiments while still within the scope of the following claims. For example, while the foregoing description refers to cleaning and treating semiconductor processing components, embodiments of the present invention may be used in connection with other components as well, including inorganic components, and particularly including ceramic handling components used in manufacturing settings other than the semiconductor field.

What is claimed is:

1. A method for cleaning a semiconductor processing component, comprising:

directing a stream of cleaning media at a surface of the component to remove material from the surface of the component, the cleaning media comprising zirconia;

directing a flow of frozen $CO_2$ pellets against the surface of the component, wherein the flow of frozen $CO_2$ pellets removes particles remaining on the surface of the component after directing the stream of cleaning media at the surface; and packaging the component in a sealed package.

2. The method of claim 1, wherein the sealed package is provided for storage and transport.

3. The method of claim 1, further comprising a step of removing the component from the packaging and loading the component with semiconductor wafers, after packaging the component.

4. The method of claim 1, wherein the semiconductor processing component is a batch processing component or a single wafer processing component.

5. The method of claim 1, wherein the component comprises an inorganic material.

6. The method of claim 1, wherein the stream of cleaning media is directed against the surface at a pressure of about 30 to about 100 psi.

7. The method of claim 1, wherein the material comprises at least one layer overlying the surface.

8. The method of claim 1, wherein the cleaning media further comprise silica.

9. The method of claim 1, wherein the cleaning media have a fracture toughness $K_c$ greater than about 4 $MPam^{0.5}$.

10. The method of claim 1, wherein the cleaning media have a loose pack density greater than 0.55.

11. The method of claim 3, further comprising a step of placing the component in a furnace, after removing the component from the package.

12. The method of claim 4, wherein the semiconductor processing component is a batch processing component, the hatch processing component being selected from the group consisting of paddles, process tubes, wafer boats, liners, pedestals, long boats, cantilever rods, wafer carriers, and vertical process chambers.

13. The method of claim 5, wherein the inorganic material is selected from the group consisting of sapphire, quartz, silicon carbide, silicon, silicon nitride, carbon, yttria, zirconia, aluminum nitride and aluminum oxide.

14. The method of claim 6, wherein the pressure is about 45 to about 75 psi.

15. The method of claim 7, wherein the material is deposited during fabrication of semiconductor devices.

16. The method of claim 8, wherein the cleaning media comprise multi-phase ceramic beads including silica and zirconia.

17. The method of claim 8, wherein the silica is present as a glassy phase.

18. The method of claim 9, wherein the fracture toughness $K_c$ is greater than about 6 $MPam^{0.5}$.

19. The method of claim 11, wherein no additional cleaning steps are carried out between removing the component from the packaging and placing the component in the furnace.

20. The method of claim 13, wherein the inorganic material is selected from the group consisting of sapphire, quartz, and silicon carbide.

21. The method of claim 15, wherein the material is selected from the group consisting of polysilicon, silicon oxide, silicon nitride, a metal, a photoresist, and combinations thereof.

22. The method of claim 15, wherein the cleaning media have a hardness that is greater than a hardiness of the material deposited during fabrication of semiconductor devices.

23. The method of claim 15, wherein the cleaning media have a density that is greater than a density of the material deposited during fabrication of semiconductor devices.

24. The method of claim 16, wherein the ceramic beads have a diameter within a range of 1 mm to about 0.05 mm.

25. The method of claim 20, wherein the inorganic material comprises silicon carbide.

26. The method of claim 20, wherein the inorganic material comprises silicon carbide, the surface of the component comprising a layer of silicon carbide, wherein the silicon carbide is formed by chemical vapor deposition.

27. The method of claim 21, wherein the material is selected from the group consisting of polysilicon, silicon oxide, and silicon nitride.

28. The method of claim 24, wherein the ceramic beads have a diameter within a range of 0.25 mm to about 0.1 mm.

29. The method of claim 25, wherein the silicon carbide comprises recrystallized silicon carbide.

30. A method for cleaning a semiconductor processing component, comprising:

directing a stream of cleaning media at a surface of the component to remove material from the surface of the component, the cleaning media comprising zirconia;

directing a flow of frozen $CO_2$ pellets against the surface of the component, wherein the flow of frozen $CO_2$ pellets removes particles remaining on the surface of the component after directing the stream of cleaning media at the surface; and packaging the component in a sealed package for storage and transport after directing the flow of frozen $CO_2$ pellets against the surface, wherein the component is removed from the packaging and used in a semiconductor fabrication process without an additional cleaning step after removal from the sealed package.

31. The method of claim 30, further comprising depositing a surface coating on the component prior to packaging.

32. The method of claim 30, wherein the component is placed in a furnace after removal from packaging.

33. The method of claim 30, wherein the component has a metallic contaminant concentration of not greater than 600 ppm.

34. The method of claim 31, wherein the surface coating is selected from the group consisting of polysilicon, silicon oxide, silicon nitride, metal, and photoresist.

* * * * *